US006563032B2

(12) United States Patent
Gregory

(10) Patent No.: US 6,563,032 B2
(45) Date of Patent: May 13, 2003

(54) MULTI-PLANAR HEADSTOCK FOR STRINGED MUSICAL INSTRUMENTS

(76) Inventor: Maestro Alex Gregory, 4821 Lankershim Blvd., Suite F, North Hollywood, CA (US) 91601

( * ) Notice: Subject to any disclaimer, the term of this patent is extended or adjusted under 35 U.S.C. 154(b) by 0 days.

(21) Appl. No.: 09/981,192

(22) Filed: Oct. 16, 2001

(65) Prior Publication Data

US 2003/0070527 A1 Apr. 17, 2003

(51) Int. Cl.[7] ..... G10D 3/00

(52) U.S. Cl. ..... 84/290; 84/291; 84/267; 84/293

(58) Field of Search ..... 84/290, 267, 291, 84/293, 268, 269, 274, 284, 285

(56) References Cited

U.S. PATENT DOCUMENTS 5,519,165 A * 5/1996 Gregory ..... 84/293
6,300,549 B1 * 10/2001 Gregory ..... 84/267

* cited by examiner

*Primary Examiner*—Shih-Yung Hsieh
(74) *Attorney, Agent, or Firm*—Sheppard, Mullin, Richter & Hampton LLP; James R. Brueggemann, Esq.

(57) ABSTRACT

A multi-plane headstock provides different planes to which strings of a stringed musical instrument may be attached to control the tension on the string and the angle at which the string breaks from the plane of the strings over the fingerboard. Advantageous musical characteristics are provided to such stringed musical instruments by implementation of the multi-planed headstock of the present invention in greater selectability and adjustability of stringed musical instrument characteristics, as well as increased internal harmony of the instrument.

20 Claims, 7 Drawing Sheets

MULTI-PLANAR HEADSTOCK FOR STRINGED MUSICAL INSTRUMENTS

BACKGROUND OF THE INVENTION

1. Field of the Invention

This invention relates to musical instruments and more particularly a headstock for stringed musical instruments.

2. Description of the Related Art

Stringed instruments have been known for many thousands of years and includes harps, violins (with fretless fingerboards), and guitars (with fretted fingerboards). When the string of a stringed instrument is plucked, it vibrates according to its harmonic modes and natural frequencies. The energy generated by the vibrating string is transmitted to the adjacent air and other parts of the musical instrument. Generally, the string itself, its qualities and characteristics, as well as the qualities and characteristics of the instrument upon which the string is strung control the tonal related qualities for the string period. Consequently, a Stradivarius violin is considered to have a much finer tone than other violins.

Les Paul invented the electric guitar by which the vibration of metal strings is picked by magnetic pickups to create an electrical and/or electronic signal for amplification and processing. In modern music, electric guitars are one of the instruments of choice due to the dynamic range, portability, and artistic expression available through it. However, guitars are not the only stringed instruments which have been subject to electrification. Under the musical instruments as developed by Maestro Alex Gregory and otherwise, a wide variety of tuned, musically aligned, or coordinated stringed musical instruments and otherwise provide a wide tonal spectrum available to the musical artist. Consequently, advancements in headstocks and other components of stringed musical instruments are applicable not only to electric guitars, but also to other electrified stringed instruments such as sitars, bouzoukis, mandolins and the like.

Sympathetic vibrations occur to adjacent portions of a stringed musical instrument when a string thereof is plucked. Generally, the vibration to the string is localized between the bridge on the body of the stringed musical instrument and the nut which is at the end of the fret board. However, in order to adjustably tune the stringed instrument, the strings extend to a headstock onto pegs or posts that are part of machine heads. Keys implementing a gear-type system turn the posts and wrap the strings around the posts. In this way, the tension on the string can be adjusted and in so doing adjust the fundamental note played by the string.

The part of the string that extends past the nut and onto the post is also subject to vibration and has a fundamental harmonic frequency associated with the length of the string between the nut and the post. Additionally, the tension upon the string can be altered to dispose the connection of the string with the post in an angle other than one which causes the string to extend in parallel to the fingerboard. In fact, as indicated in Maestro Alex Gregory's prior U.S. Pat. No. 5,519,165 for a compound headstock for a stringed musical instrument issued May 21, 1996, certain geometries may be used in headstocks in order to provide certain advantageous features such as allowing increased tension on the string while ensuring delivery of the proper note on that string. Such increased tension may require the alteration of the diameter of the string or otherwise in order to conform to the tonal preferences of the artist. However, as shown in the Gregory '165 Patent, a compound headstock is known in the art that offsets machine heads from the plane of the fingerboard.

However, in advancing the art, Maestro Alex Gregory has found that certain advantageous qualities are delivered by advancing the art with respect to headstocks. Prior headstocks generally do not provide separate planes for each string or strings of similar characteristics. Additionally, no prior headstock provides advantageous and systematic means by which such multi-planar positioning of the string-attaching machine heads of the headstock can be achieved. Due to the tensions present on such strings, structural accommodations may need to be made in order to ensure that the headstock is not too brittle or fragile for the tensions applied by the strings.

Consequently, it would be an advantageous gain in the art to achieve a multi-planar headstock system and provide greater adjustability, tunability, tension adjustment, and harmonious interaction with the main portion of the played or plucked string. The present invention addresses these shortcomings in the art as well as others.

SUMMARY OF THE INVENTION

The present invention provides a multi-planar headstock that provides greater adjustability in the angle a string takes when traveling past the fingerboard and onto machine heads or adjustable or other string anchors. Additionally, the present invention provides greater adjustability and tunability for the string tension and for the string section present between the nut to the post. By providing a multi-planar headstock, the balance of the ratio of string weight to length is better coordinated. Additionally, improved headstock resonance occurs when the headstock picks up the resonant energy of the played strings.

All these advantages of the present invention are achieved through a headstock having a step-like appearance to provide different planes, or bases, to which each of the strings is attached. Preferably, the lowest string, that is the string with the lowest note, has the greatest extension past the nut and the greatest angle with respect to the fingerboard. The highest string, the string playing the highest note, preferably has the shortest extension past the nut and the shallowest angle with respect to the fingerboard. Intermediate strings between the lowest and highest string are correspondingly spaced away from the nut and are set at angles intermediate and between those of the lowest and highest strings. Certain preferable architectures and design for such a multi-planar headstock can be effective for specific instruments having specific numbers of strings and certain tonal qualities. These include banjos, bouzoukis, sitars, mandolins, and newly-synthesized stringed instruments taking advantage of newer technologies including those set forth herein.

OBJECTS OF THE INVENTION

It is an object of the present invention to provide stringed musical instruments that are more internally harmonious.

It is another object of the present invention to provide more harmonious stringed musical instruments that are more adjustable and tunable.

It is yet another object of the present invention to provide more harmonious stringed musical instruments that allow greater or lesser tensions to be applied to the strings.

It is yet another object of the present invention to provide a headstock for stringed musical instruments that provide for a greater instrument harmony and playability.

It is yet another object of the present invention to provide a multi-planar headstock that allows the strings to be attached to the headstock and angles departing the plane of a fingerboard.

It is yet another object of the present invention to provide a multi-planar headstock that is sufficiently strong to allow the strings to be attached in different planes to different bases.

It is yet another object of the present invention to provide a system for attaching strings to a musical instrument in an adjustable manner that provides for adjustability in the angle the string departs from the plane of the fingerboard, adjustability of the overall string tension, tunability of the headstock string section from the nut to the post, and the balance of ratio of string weight to length, and the resonance of the headstock.

These and other objects and advantages of the present invention will be apparent from a review of the following specification and accompanying drawings.

DESCRIPTION OF THE PREFERRED EMBODIMENT(S).

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

As shown in the Figures, the multi-planar headstock for stringed musical instruments of the present invention provides different bases having different levels for the attachment of individual strings to the headstock. This provides several unique advantages and features otherwise unavailable by single-plane configurations of such headstocks.

Figure 1:
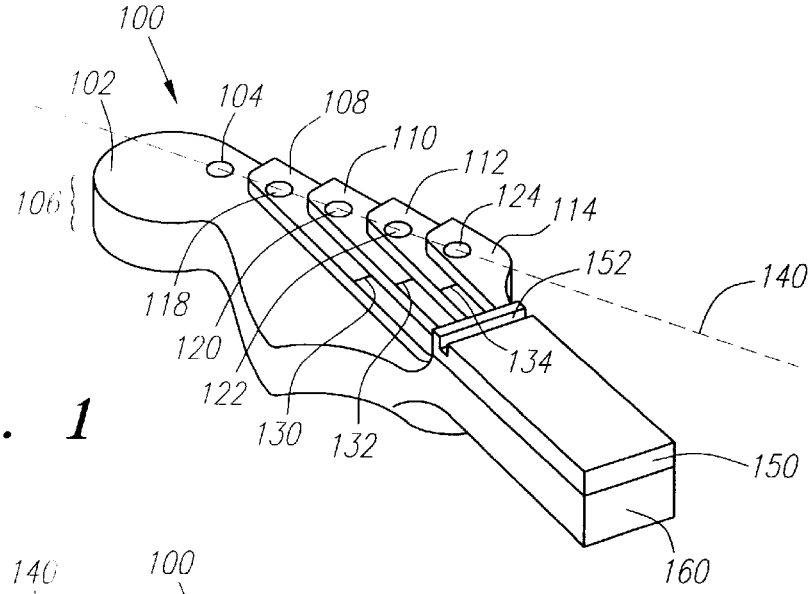
FIG. 1 is an upper left rear perspective view of the multi-planar headstock of the present invention.
Figure 2:
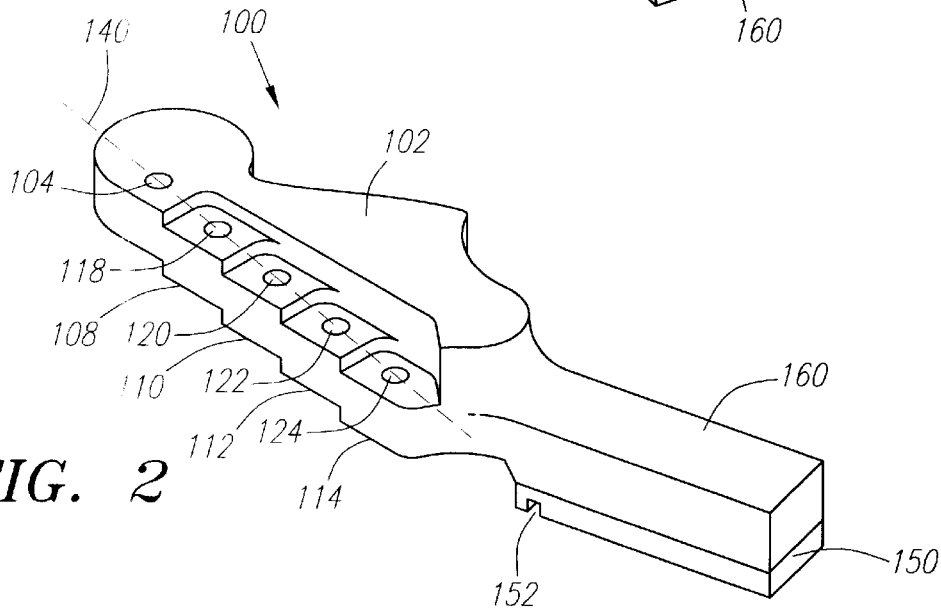
FIG. 2 is a lower rear right perspective view of the headstock shown in FIG. 1.
Figure 3:
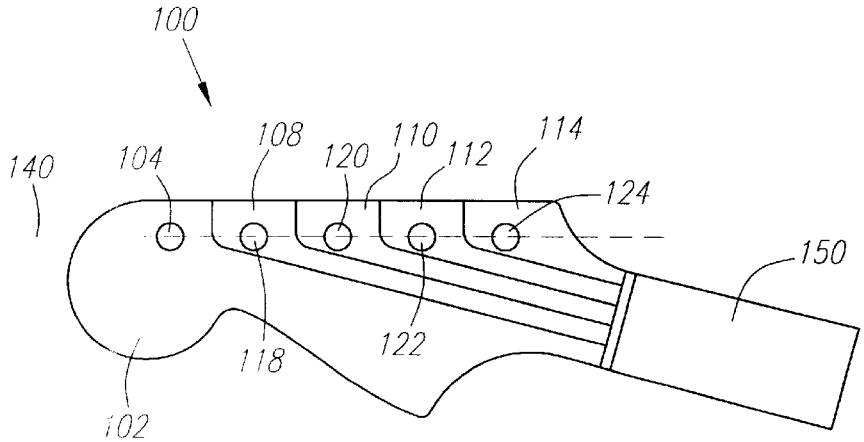
FIG. 3 is a top plan view of the headstock shown in FIG. 1.
Figure 4:
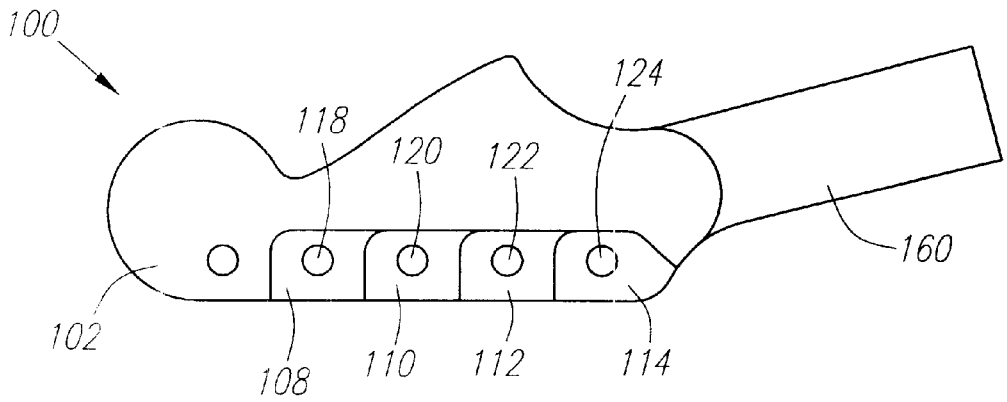
FIG. 4 is a bottom plan view of the headstock shown in FIG. 1.

As shown in FIG. 1, the multi-planar headstock 100 of the present invention is shown in a generally detached manner from the remainder of the instrument.

The headstock 100 has a foundational base 102 upon which or from which the remaining bases are attached. Note should be taken that while a single progression of bases is shown in FIG. 1 and the accompanying Figures, two or more such progressions could also be achieved and incorporate the present invention.

The foundational base 102 is generally a flat piece of solid wood from which are cut the remaining bases, or pedestals, of the multi-planar headstock. A machine head aperture 104 is bored or cut into the foundational base 102 in order for a machine head to be attached to the headstock 100 through the aperture 104.

The foundational base 102 should have and provide sufficient structure in order to support the stresses and strains imposed upon the headstock 100 by the strings (not shown). As known in the art, the strings exert a pull towards the bridge of the stringed instrument so as to produce tones when the strings are plucked or played. If adequate materials are used, the foundational base 102 may be correspondingly thin. However, with wood and other similar materials, a thickness of approximately 9/16ths of an inch is contemplated for the width 106 of the foundational base 102. Unless otherwise mentioned herein, the headstock 100 is presumably made of wood or other similar materials. However, those in the art will understand that certain allowances and accommodations can be made for other substances, such as a reinforced graphite or the like, that could provide alternative materials for use in the present invention.

The headstock 100 shown in FIG. 1 is designed for use with a five stringed instrument such as a five string guitar. As shown in FIG. 1, a second base 108 projects upwardly from the plane of the foundational base. Correspondingly, a third base 110, a fourth base 112, and a fifth base 114 project upwardly from each preceding base. As described in more detail below, each of the bases may be approximately 7/16ths inches above the prior base. However, certain specific configurations may be achieved with respect to the upward extension of each of the bases from the prior base. Each of the bases has a corresponding machine head apertures with machine head apertures 118, 120, 122, and 124 corresponding to second base 108, third base 110, fourth base 112, and fifth base 114, respectively.

Each of the upwardly extending bases, beginning with the second base 108, has a lateral extending portion 130, 132, and 134. Each of these extensions lend additional support for the succeeding base. In this manner, the apertures 104, 118–124 are not parallel to the strings of the musical instrument, but are at an oblique angle to such strings. While the apertures 104, 118–124 are in line with one another, they are not in line with the strings and so enable an additional measure of structural support to be provided for each of the bases by the angular offset between the strings and the aperture line 140. The line or axis 140 is shared by the machine head apertures. As each of the bases succeeding the foundational base 102, namely the second base 108, third base 110, fourth base 112, and fifth base 114, generally cantilever up and away from the foundational base 102. The extending lateral extensions 130–134 provide additional support for each corresponding base and enable the corresponding base to better withstand the stresses involved.

As shown in FIG. 1, the fingerboard 150 has a slot 152 for holding the nut (not shown). The neck of the guitar 160 underlies the fingerboard and serves to support the fingerboard 150. A truss rod (not shown) generally travels through the neck in a manner generally known for guitars. Only a Fender®-style truss rod adjustable at the body-end of the fingerboard will be present in some stringed instruments incorporating the present invention.

Figure 5:
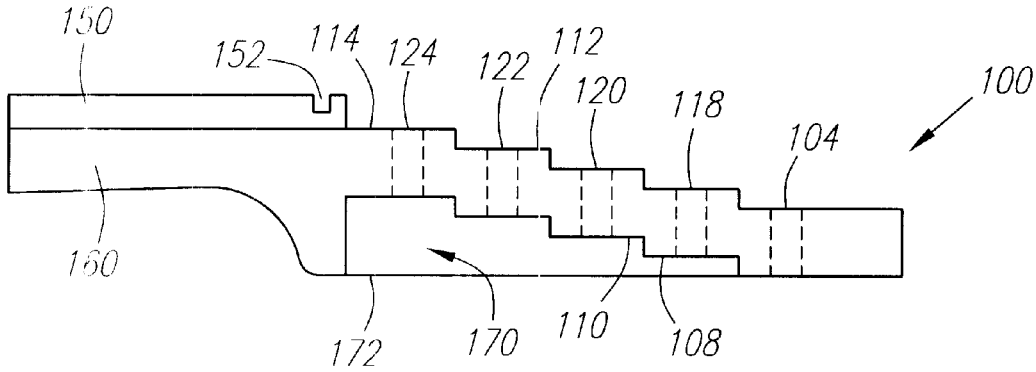
FIG. 5 is a right side plan view of the headstock shown in FIG. 1 with the phantom lines showing the apertures for the posts.
Figure 6:
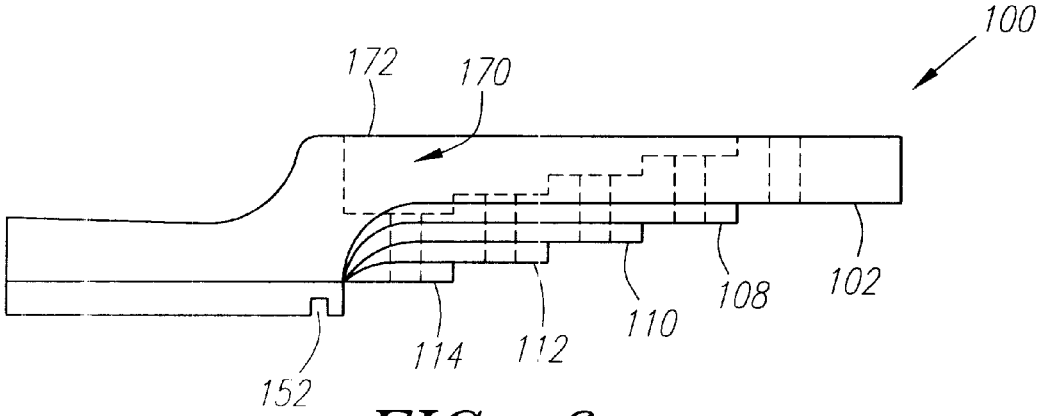
FIG. 6 is a left side elevational view of the headstock shown in FIG. 1 corresponding to the right side elevational view of the headstock shown in FIG. 2. The phantom lines show areas where the headstock has been cut out including for the base pads for posts.

As shown in FIGS. 5 and 6, part of the back of the headstock 100 may be cut out in order to achieve the present invention. Consequently, an initial headstock workpiece is approximately the entire thickness and length of the headstock from the which the bases and the apertures are cut out. As shown in FIGS. 5 and 6, the back side of the head stock 100 may have a cut away portion 170 into which the machine heads may fit. The remaining portion of 172 of the back side of the headstock 100 remains to provide structural support and integrity for the headstock 100.

FIGS. 7–19 show alternative embodiments of the present invention. Particularly, FIGS. 7–12 show a four level headstock 700 having the lowest two strings attached to the foundational base 702 and the remaining three higher strings connect to second, third, and fourth bases 710, 712, 714, respectively. In.many ways, the headstock 700 shown in FIGS. 7–12 is similar to that shown in FIGS. 1–6 and corresponding elements are referred by similar (but offset) reference numbers.

The headstock 700 shown in FIGS. 7–12 may serve as a base for a Pentabouzouki as previously disclosed in the prior patent application submitted by the present inventor, application Ser. No. 09/511,898 filed Feb. 25, 2000, for Improved String Musical Instruments and Method Therefore which application is incorporated herein by this reference thereto. As the lowest strings on a Pentabouzouki are the same (but only separated by an octave), the present invention accommodates such a stringed musical instrument by allowing both such strings to be affixed to the headstock 700 at the same level. In an alternative embodiment, both such strings may be set into the headstock 700 at the same distance from the nut slot 752 in order to provide more harmonic response and better operation.

Figure 16:
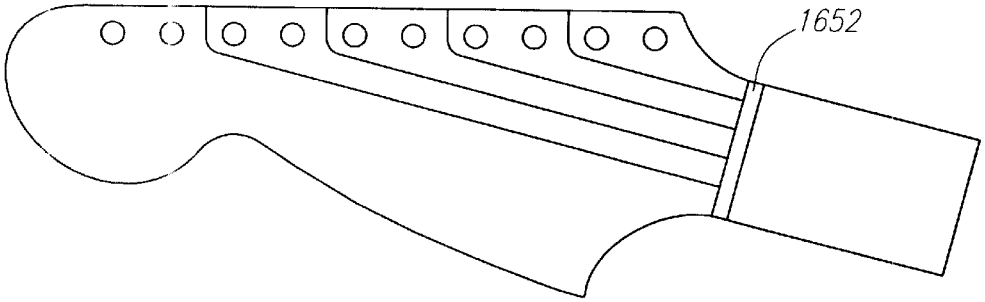
FIG. 16 is a top plan view of a headstock for a ten string musical instrument, including a Penta-type guitar as designed by Maestro Alex Gregory.

As seen FIG. 16, a guitar having five strings may be "doubled up" much in the same manner as a 12 string guitar doubles up on a six string guitar. The "Penta X" design for such a guitar allows each of the similar strings to be disposed at the same level. In an alternative embodiment, such similar strings may be disposed at the same length from the nut or nut slot 1652.

It can be seen, that strings of similar tone and note may be disposed at the same level on the headstock of the present invention and generally affixed to the corresponding machine head and its post generally the same distance from the nut or nut slot. In this way, the strings operate in a better manner and in a more harmonious fashion enabling less dissonance to be created by the energy transmitted by the plucked string to that part of the string between the nut or nut slot and the post of the machine head.

Figure 13:
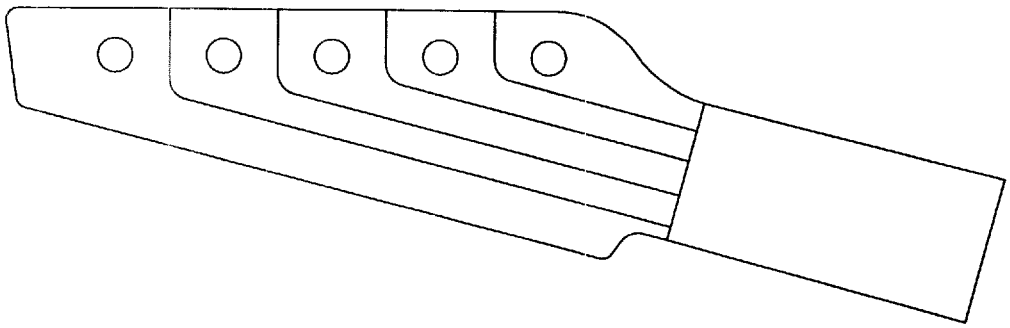
FIGS. 13–15 are top plan views of alternative headstock embodiment designs for the headstock shown in FIG. 1 and FIG. 7.
Figure 14:
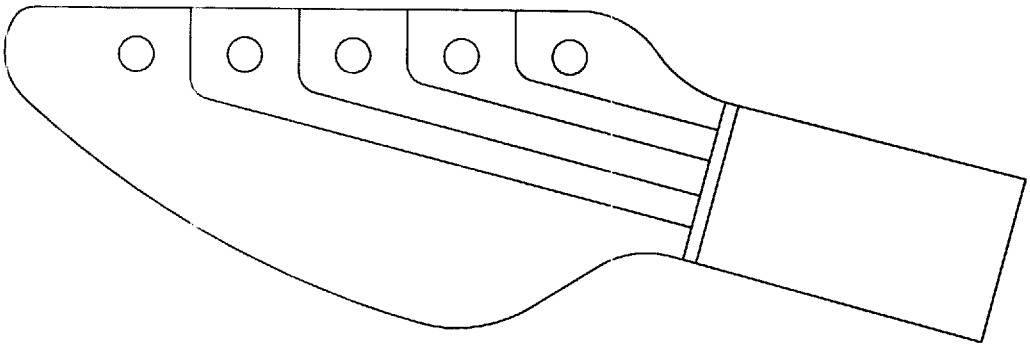
Figure 15:
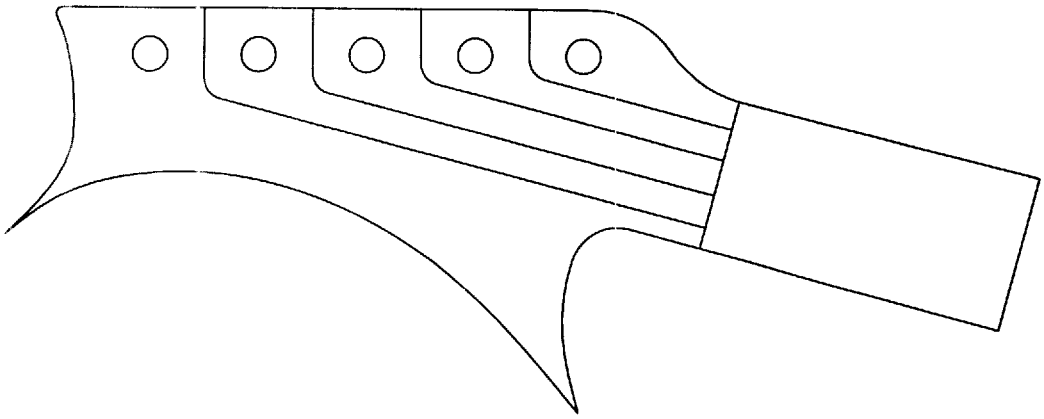
Figure 17:
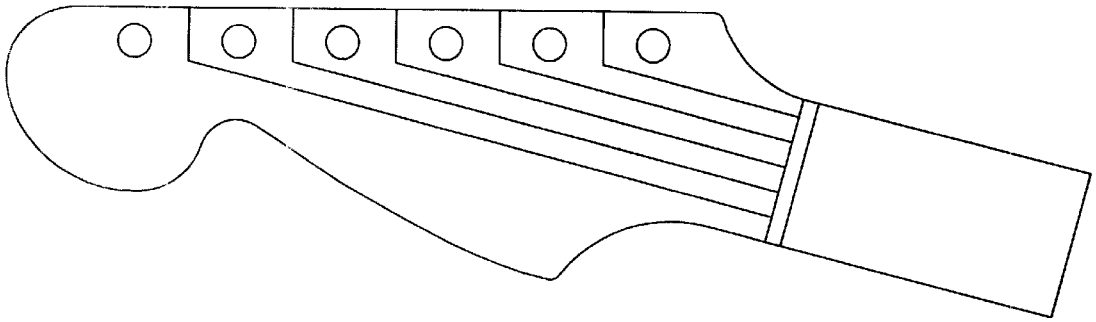
FIG. 17 is a top plan view of an embodiment for a six string headstock.
Figure 18:
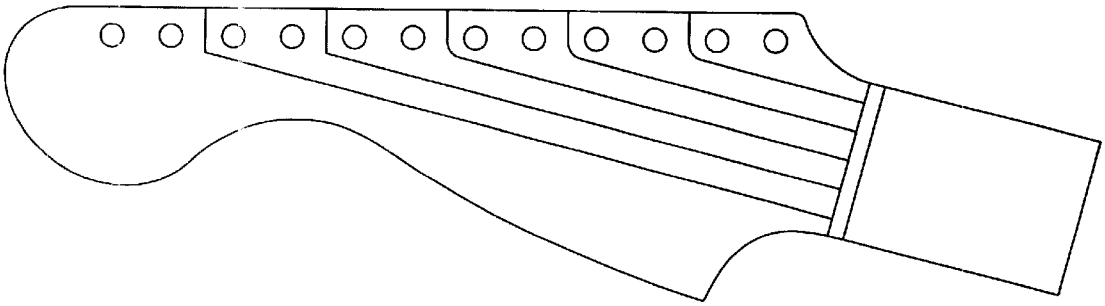
FIG. 18 is a top plan view of an embodiment for a 12 string headstock.
Figure 19:
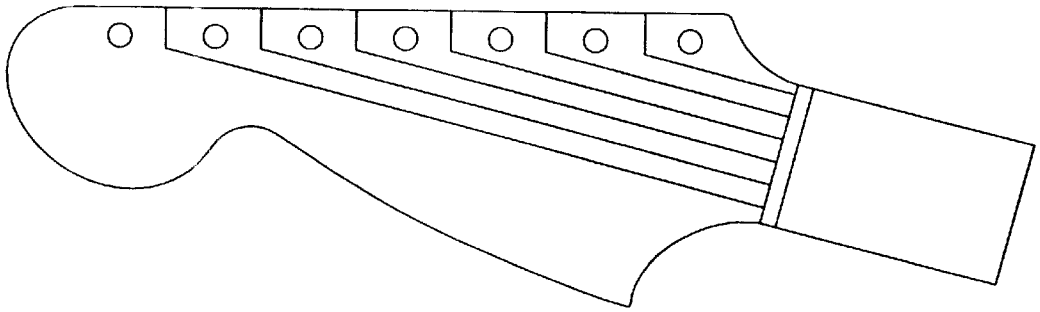
FIG. 19 shows a top plan view of a 7 string headstock.

FIGS. 13–15 show alternative embodiments for a five string headstock such as that shown in FIG. 1. FIGS. 17–19 show six string, twelve string, and seven string embodiments of the present invention, indicating the utility and adaptability of the present invention to a wide variety of musical instruments.

Figure 7:
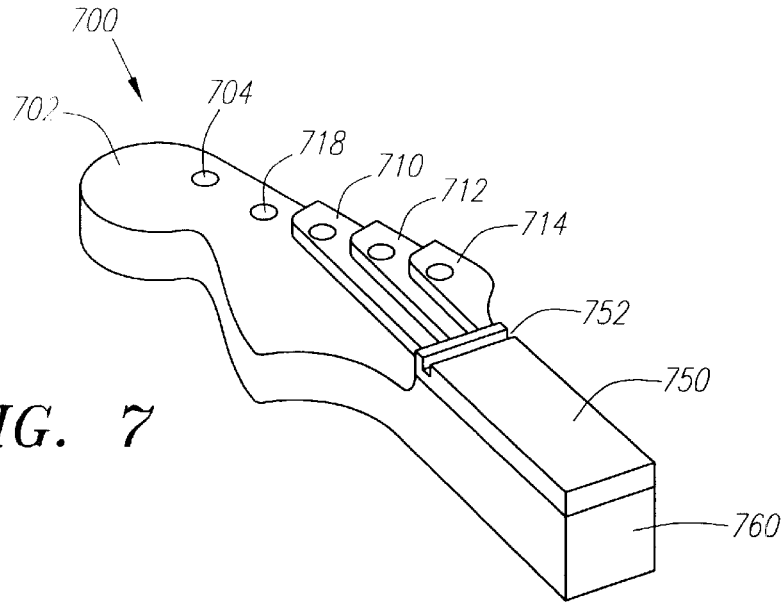
FIGS. 7–12 are views similar to those for FIGS. 1–6 where the headstock provides four levels instead of five levels as shown in FIGS. 1–6.
Figure 8:
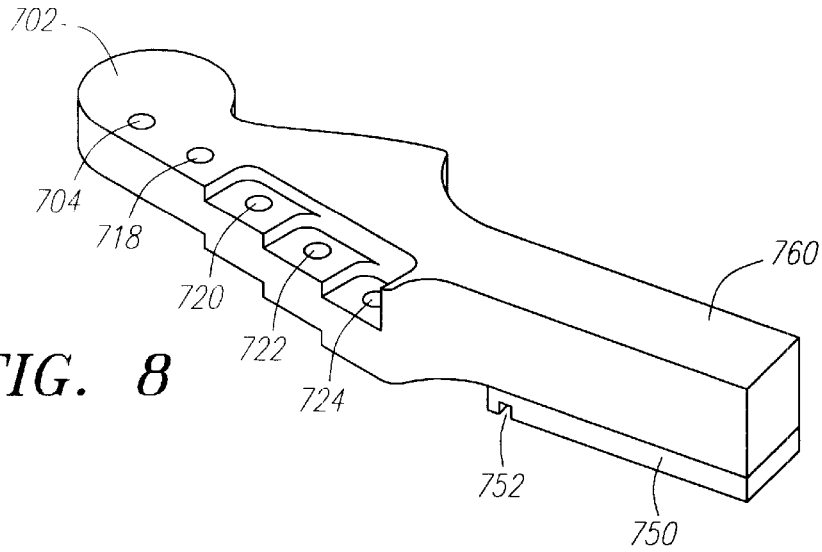
Figure 9:
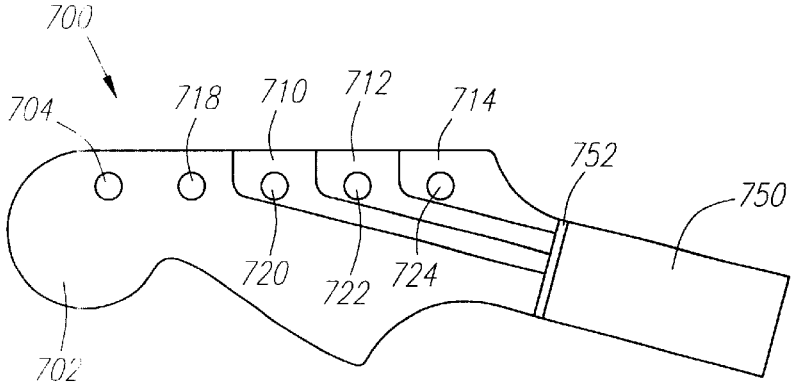
Figure 10:
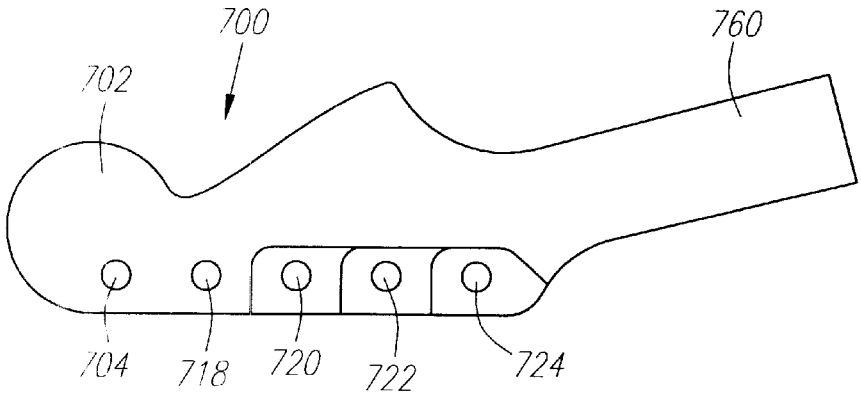
Figure 11:
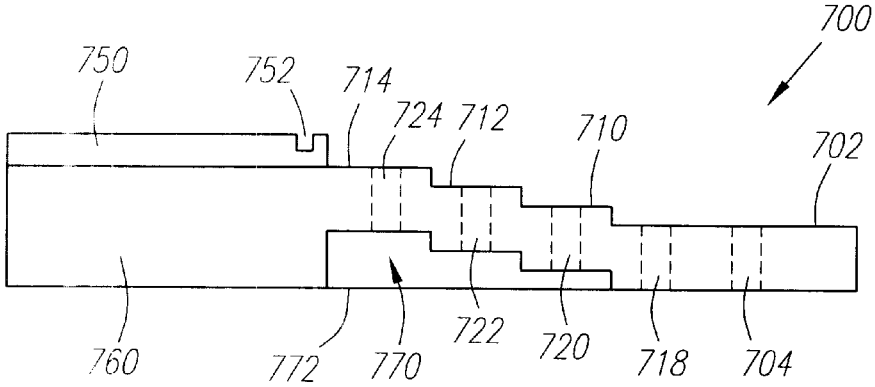
Figure 12:
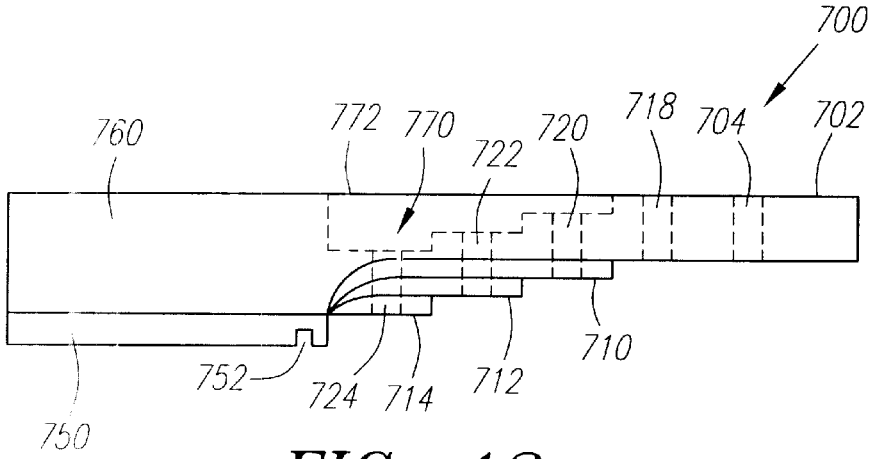
Figure 20:
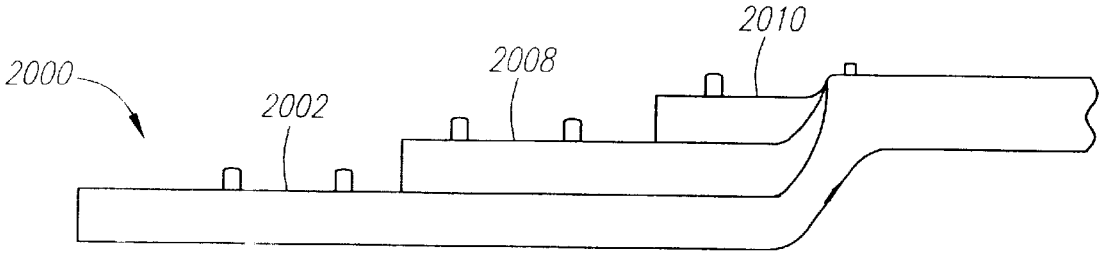
FIG. 20 is a side elevational view of a headstock for use for a five string or Pentabouzouki as designed by Maestro Alex Gregory.

FIG. 20 shows an alternative embodiment of the headstock shown in FIG. 7 where the headstock 2000 generally has three levels: one for the lowest strings, 2002, one for the two middle strings 2008 and one for the highest string 2010.

Pentabouzouki headstock 2000, FIG. 20, also indicates the adaptability of the present invention as to provide bases having a variety of levels in order to accommodate the musical qualities of stringed instruments that incorporate the present invention.

Figure 21:
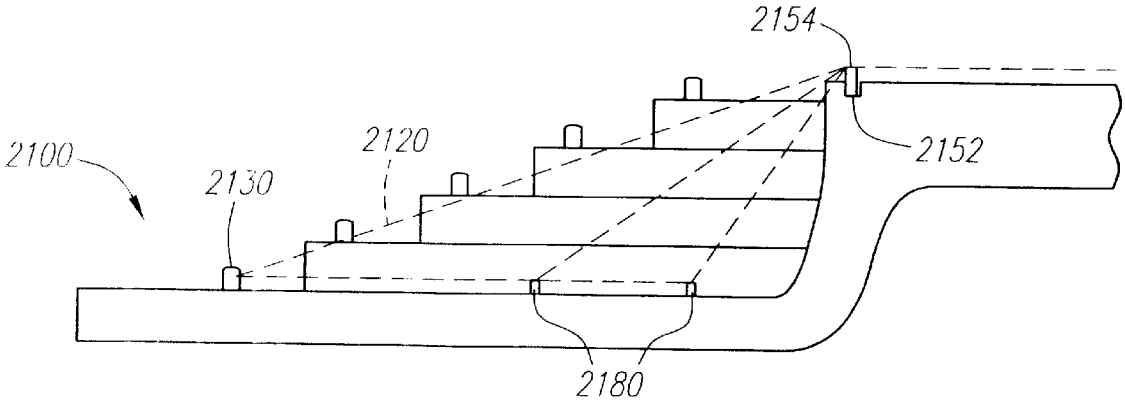
FIG. 21 is a left side elevational view of a headstock according to the present invention as shown in FIG. 1 with the lowest base string shown attached to the headstock by string trees in alternative position embodiments prior to attachment to the post.

In FIG. 21, alternative embodiments of the attachment and/or stringing of strings used in conjunction with the present invention are shown. FIG. 21 shows three alternative embodiments for the stringing of the lowest string of a five string guitar or the like (such as those known as the Celloblaster or the Pentatar in the associated Gregory patent application). In FIG. 21, the headstock 2100 has a bass string 2120 which is attached to the bass string post 2130. In FIG. 21, the nut slot 2152 holds the nut 2154. The bass string 2120 is strung over the fingerboard 2150, past the nut 2154 and onto the bass string machine head post 2130. A string tree 2180 serves to control the approach of the bass string 2120 to the headstock 2100. A string tree may be placed half way between the nut 2154 and the post 2130 in order to define equal lengths of the bass string 2120 between the nut 2154 and the post 2130. Alternatively, the string tree 2180 may be disposed as a position on the headstock 2100 so that one quarter of the bass string 2130 travels to the string tree 2180 before proceeding on to the post 2130. Both of these positions provide harmonic operation for the bass string 2120 especially if the bass string headstock length is a harmonic of the length of the bass string over the fingerboard, namely the length of a bass string from the bridge (not shown) to the nut 2150.

In one embodiment, each of the posts for the machine head passing though apertures present in headstocks implementing the present invention may be 9/16ths inches away from the forward most end of the base. However, while certain accommodation of other factors may require certain specifications to be implemented in the headstock of the present invention, so long as the machine head is properly attached to the headstock and the headstock and machine head can properly withstand the string tensions involved, the placement of the machine heads may be such as that preferred by the artist playing the stringed instrument or the craftsman creating it.

Having set forth above the construction and architecture of the multi-planar headstock of the present invention, description is made below with regards to its operation and implementation.

The present invention allows for adjustability of the angle taken by the string and departing from the plane of the fingerboard. The angle is determined by the position of the post to which the string is attached and can be placed generally on the headstock at any vertical or horizontal position thereon. This string-breaking angle from the nut to the post provides the ability to better adjust and control the tension of the string in conjunction with the tensioning provided by the machine head. The adjustability of the overall string tension is generally available regardless of the scale length of the string and provides better means by which such string tension can be controlled by the musician.

With the selectability of the machine head post's location, the tunability of the headstock string section (the string section from the nut to the post) is made available either with or without the additional aid of adjustable or other string trees. This tunability of the headstock string section enables a more perfect headstock harmonization, if not a completely perfect headstock harmonization, that was otherwise unavailable through other headstocks present in the prior art.

The balance between the ratio of the string weight and the string length is better balanced by the multi-planar headstock of the present invention. Lower and heavier strings are believed to be more harmonic and to provide better musical response if they are longer. By providing longer headstock string lengths (from the nut to the post in the headstock), the present invention provides better balance of the ratio between the string weight and length and provides better responsive harmony.

The multi-planar headstock system of the present invention provides improved headstock resonance, as the headstock has a significantly thicker center part that contributes better to the resonance arising in the headstock.

As mentioned above, the headstock of the present invention can be adapted to many types and kinds of stringed musical instruments and variations according to instrument, tuning, the number of strings, the tension required, and/or the scale length required. Such characteristics can be accommodated by the headstock of the present invention with adaptations and accommodations made as necessary. As an example of this, if more tension is required with a shorter scale, the stepping or difference of levels of each headstock plane can be deepened or made greater in order to reach the desired effect.

With the present invention, certain prior standards for headstocks may be used or modified in order to provide the musician more familiar playability. The standard thickness of current headstocks using a single plane is approximately ½ inch. Headstocks made by Fender in the 1950's were formerly 9/16ths inches thick. In embodiments of the present invention, use of the 9/16ths thickness is one thickness seen as having certain benefits and may be preferred for, some applications, although some headstocks may use thinner thicknesses in order to obtain a more shallow headstock with less tension or may use thicker thicknesses in order to obtain a deeper headstock with greater tension.

Generally, a minimum of 2/16ths inches must be maintained between the bases in order to avoid the bases splitting and falling apart. This is a significant consideration with respect to wood headstocks. As most headstocks are normally made of wood, such minimum thicknesses should be maintained unless other materials are used or the wood is otherwise reinforced to avoid splitting and breaking apart.

Certain embodiments or certain instruments, including those of the Penta-orchestra system disclosed in the Gregory patent application, above, are set forth in more detail below.

For a Pentabass (a five-stringed bass instrument) which generally incorporates the Penta system of tuning and uses five strings, the foundational base headstock thickness may be 9/16ths inches with the second base being 7/16ths inches above that, the third base being 7/16ths inches above the second base, the fourth base being 7/16ths inches above the third base, the fifth base being 9/16ths inches above the fourth base with the fifth base being approximately 4/16ths inches below the level of the plane defined by the fingerboard. In such an embodiment, the total neck thickness is generally and approximately 2 and ½ inches.

For a Celloblaster according to the Gregory application indicated above, the plane or offset distances may be generally as follows: the foundation base may be approximately 9/16ths inches thick with the second base being 5/16ths inches above the foundation base. The third, fourth and fifth bases may be each be 5/16ths inches above the previous base with the distance of the highest or fifth base approximately 2/16ths inches below the level of the plane defined by the fingerboard.

For other five-stringed instruments (including the Pentatar, being a five string guitar tuned according to the Penta tuning system described in the Gregory application indicated above), the base foundation thickness may be 9/16ths inches with the second base level being 4/16ths inches above the foundation level. The third base level may be approximately 4/16ths inches above the second base level with the fourth and fifth base level being 3/16ths inches above the previous level. The highest base, being the fifth base, maybe approximately 2/16ths inches below the fingerboard.

For five-stringed instruments such as the Pentaula and Pentalin, the following headstock levels may be implemented. The base foundation thickness may be 9/16ths inches with the second base level being approximately 4/16ths inches above the base foundation. The third, fourth and fifth base levels may be 3/16ths inches above the previous base level with the highest or fifth base level being flush to the end of the fingerboard. In this embodiment for the Pentaula and Pentalin, the total neck thickness is approximately 1 and 6/16ths inches.

The Pentabouzouki as described in the above-mentioned Gregory patent application has the bottom string an octave up from the next string in g/G/D/A/E or c/C/G/D/A and does not need five separate planes for the headstock even though it has five strings. Instead, only four separate planes are necessary and under such circumstances, the base level vertical distances will generally be as follows: the base foundation may be 9/16ths inches thick with a second base level being 4/16ths inches above the top of the foundation base level. The third and fourth base levels may be 3/16ths inches above the prior base levels with the top or fourth base level flush to the end of the fingerboard. The total neck thickness for the Pentabouzouki configuration may be approximately 1 and 3/16ths inches with the two bottom strings (g/G or c/C) attached to the base foundation as indicated in FIGS. 7–12.

The ratios set forth above generally refer to scale lengths of instruments according to the Pentasystem, Penta-orchestra and Penta-tuning system. Consequently, the actual ratios set forth herein act as a starting point from which other scales or effects may be achieved by reference to these distance ratios. Other stringed instruments, including current stringed instruments such as the violins and six-string guitars, may put the multi-planar headstock of the present invention to good use by adaptation.

Additional options include five elongated planes for a double coursed Pentatar such as the Pentatar X as indicated in FIG. 16. Six planes for a six string guitar are indicated in FIG. 17 and six elongated planes for a 12 string guitar are indicated in FIG. 18. Seven no planes for a seven string guitar are indicated in FIG. 19 while eight planes for an eight string guitar as easily extrapolated therefrom. A four string bass guitar may have four planes, as may a four string mandolin. For an eight string bouzouki having four double courses, four elongated planes may be used while in a similar manner three elongated planes may be used for a six string bouzouki having three double courses. A tenor banjo may have four planes in its headstock and similar accommodations may be made for similar instruments according to the present invention. The above indicated options may have many variants according to the gauge of the strings used, the tension required, the desired scale length as well as other string characteristics.

While the present invention has been described with regards to particular embodiments, it is recognized that additional variations of the present invention may be devised without departing from the inventive concept.

What is claimed is:

1. A headstock providing angled string attachment points for a stringed instrument having strings strung over a fingerboard; comprising:

a first base at a first level;

a second base at a second level offset from and aligned with said first level; and a third base at a third level offset from and aligned with said first and second levels;

wherein said first, second, and third bases are configured to be coupled to strings at respective first, second, and third angles with respect to the fingerboard.

2. A headstock providing angled string attachment points for a stringed instrument having strings strung over a fingerboard as set forth in claim 1, further comprising:

a first string having a first overall headstock length from a proximal end of the fingerboard to an ultimate attachment point of said first string to said first base and said first string having a first fingerboard length from said proximal end of the fingerboard to a distal anchor point of said first string, said first overall headstock length being a harmonic of said first fingerboard length.

3. A headstock providing angled string attachment points for a stringed instrument having strings strung over a fingerboard as set forth in claim 1, further comprising:

a first string having a first primary headstock length from a proximal end of the fingerboard to a string tree coupling said first string to said first base and said first string having a first fingerboard length from said proximal end of the fingerboard to a distal anchor point of said first string, said first primary headstock length being a harmonic of said first fingerboard length.

4. A headstock providing angled string attachment points for a stringed instrument having strings strung over a fingerboard as set forth in claim 1, further comprising:

said first angle greater than said second angle;

a first string coupled to said first base at said first angle being a string playing lower notes; and a second string coupled to said second base at said second angle being a string playing notes higher than said first string.

5. A headstock providing angled string attachment points for a stringed instrument having strings strung over a fingerboard as set forth in claim 4, further comprising:

said first string longer than said second string as measured from a common distal anchor line to points of attachment to respective first and second bases for said first and second strings.

6. A headstock providing angled string attachment points for a stringed instrument having strings strung over a fingerboard as set forth in claim 1, further comprising:

said first base providing a first key aperture;

a first key fitting within said first key aperture, said first key having a first post;

said first post coupled to a first string and providing an adjustable and ultimate anchor point for said first string, said first string disposed at said first angle with respect to the fingerboard.

7. A headstock providing angled string attachment points for a stringed instrument having strings strung over a fingerboard as set forth in claim 1, further comprising:

the stringed instrument being a five-string bass-like instrument;

said second level being approximately $7/16^{ths}$ (0.4375) inches from said first level;

said third level being approximately $7/16^{ths}$ (0.4375) inches from said second level;

a fourth base at a fourth level offset from and aligned with said first, second, and third levels, said fourth level being approximately $7/16^{ths}$ (0.4375) inches from said third level; and a fifth base at a fifth level offset from and aligned with said first, second, third, and fourth levels, said fifth level being approximately $6/16^{ths}$ (0.375) inches from said fourth level, said fifth level being approximately $4/16^{ths}$ (0.25) inches below the fingerboard.

8. A headstock providing angled string attachment points for a stringed instrument having strings strung over a fingerboard as set forth in claim 1, further comprising:

the stringed instrument being a five-string cello-like instrument;

said second level being approximately $5/16^{ths}$ (0.3125) inches from said first level;

said third level being approximately $5/16^{ths}$ (0.3125) inches from said second level;

a fourth base at a fourth level offset from and aligned with said first, second, and third levels, said fourth level being approximately $5/16^{ths}$ (0.3125) inches from said third level; and a fifth base at a fifth level offset from and aligned with said first, second, third, and fourth levels, said fifth level being approximately $5/16^{ths}$ (0.3125) inches from said fourth level, said fifth level being approximately $2/16^{ths}$ (0.125) inches below the fingerboard.

9. A headstock providing angled string attachment points for a stringed instrument having strings strung over a fingerboard as set forth in claim 1, further comprising:

the stringed instrument being a five-string guitar-like instrument;

said second level being approximately $4/16^{ths}$ (0.25) inches from said first level;

said third level being approximately $4/16^{ths}$ (0.25) inches from said second level;

a fourth base at a fourth level offset from and aligned with said first, second, and third levels, said fourth level being approximately $3/16^{ths}$ (0.1875) inches from said third level; and a fifth base at a fifth level offset from and aligned with said first, second, third, and fourth levels, said fifth level being approximately $3/16^{ths}$ (0.1875) inches from said fourth level, said fifth level being approximately $2/16^{ths}$ (0.125) inches below the fingerboard.

10. A headstock providing angled string attachment points for a stringed instrument having strings strung over a fingerboard as set forth in claim 1, further comprising:

the stringed instrument being a five-string viola-like instrument;

said second level being approximately $4/16^{ths}$ (0.25) inches from said first level;

said third level being approximately $3/16^{ths}$ (0.1875) inches from said second level;

a fourth base at a fourth level offset from and aligned with said first, second, and third levels, said fourth level being approximately $3/16^{ths}$ (0.1875) inches from said third level; and a fifth base at a fifth level offset from and aligned with said first, second, third, and fourth levels, said fifth level being approximately $3/16^{ths}$ (0.1875) inches from said fourth level, said fifth level being approximately flush with the fingerboard.

11. A headstock providing angled string attachment points for a stringed instrument having strings strung over a fingerboard as set forth in claim 1, further comprising:

the stringed instrument being a five-string violin-like instrument;

said second level being approximately $4/16^{ths}$ (0.25) inches from said first level;

said third level being approximately $3/16^{ths}$ (0.1875) inches from said second level;

a fourth base at a fourth level offset from and aligned with said first, second, and third levels, said fourth level being approximately $3/16^{ths}$ (0.1875) inches from said third level; and a fifth base at a fifth level offset from and aligned with said first, second, third, and fourth levels, said fifth level being approximately $3/16^{ths}$ (0.1875) inches from said fourth level, said fifth level being approximately flush with the fingerboard.

12. A headstock providing angled string attachment points for a stringed instrument having strings strung over a fingerboard as set forth in claim 1, further comprising:

the stringed instrument being a five-string bouzouki-like instrument with two strings coupled to said first base;

said second level being approximately $4/16^{ths}$ (0.25) inches from said first level;

said third level being approximately 3/16ths (0.1875) inches from said second level; and a fourth base at a fourth level offset from and aligned with said first, to second, and third levels, said fourth level being approximately $3/16^{ths}$ (0.1875) inches from said third level, said fourth level being approximately flush with the fingerboard.

13. A headstock providing angled string attachment points for a stringed instrument having strings strung over a fingerboard as set forth in claim 1, further comprising:

the stringed instrument being a ten-string instrument having five double courses;

a fourth base at a fourth level offset from and aligned with said first, second, and third levels;

a fifth base at a fifth level offset from and aligned with said first, second, third, and fourth levels;

said first base enabling a first pair of strings to be coupled to said first base;

said second base enabling a second pair of strings to be coupled to said second base;

said third base enabling a third pair of strings to be coupled to said third base;

said fourth base enabling a fourth pair of strings to be coupled to said fourth base; and said fifth base enabling a fifth pair of strings to be coupled to said fifth base.

14. A headstock providing angled string attachment points for a stringed instrument having strings strung over a fingerboard as set forth in claim 1, further comprising:

the stringed instrument being a twelve-string instrument having six double courses;

a fourth base at a fourth level offset from and aligned with said first, second, and third levels;

a fifth base at a fifth level offset from and aligned with said first, second, third, and fourth levels;

a sixth base at a sixth level offset from and aligned with said first, second, third, fourth, and fifth levels;

said first base enabling a first pair of strings to be coupled to said first base;

said second base enabling a second pair of strings to be coupled to said second base;

said third base enabling a third pair of strings to be coupled to said third base;

said fourth base enabling a fourth pair of strings to be coupled to said fourth base;

said fifth base enabling a fifth pair of strings to be coupled to said fifth base; and said sixth base enabling a sixth pair of strings to be coupled to said sixth base.

15. A headstock providing angled string attachment points for a stringed instrument having strings strung over a fingerboard as set forth in claim 1, further comprising:

a fourth base at a fourth level offset from and aligned with said first, second, and third levels a fifth base at a fifth level offset from and aligned with said first, second, third, and fourth levels; and a sixth base at a sixth level offset from and aligned with said first, second, third, fourth, and fifth levels.

16. A headstock providing angled string attachment points for a stringed instrument having strings strung over a fingerboard as set forth in claim 15, further comprising:

a seventh base as a seventh level offset from and aligned with said first, second, third, fourth, fifth, and sixth levels.

17. A headstock providing angled string attachment points for a stringed instrument having strings strung over a fingerboard as set forth in claim 1, further comprising:

a first string coupled to said first base by a string tree.

18. A headstock providing angled string attachment points for a stringed instrument having strings strung over a fingerboard as set forth in claim 17, further comprising:

said first string making said first angle with respect to said fingerboard; and said string tree increasing said first angle by coupling said first string to said first base closer to said fingerboard.

19. A headstock providing angled string attachment points for a stringed instrument having strings strung over a fingerboard, comprising:

a first base at a first level, said first base providing a first key aperture;

a second base at a second level offset from and aligned with said first level;

a third base at a third level offset from and aligned with said first and second levels said first, second, and third bases are configured to be coupled to strings at respective first, second, and third angles with respect to the fingerboard, said first angle greater than said second angle;

a first key fitting within said first key aperture, said first key having a first post;

said first post coupled to a first string and providing a first adjustable and ultimate anchor point for said first string, said first string disposed at said first angle with respect to the fingerboard;

said first string coupled to said first base at said first angle being a string playing lower notes;

a second string coupled to said second base at a second adjustable and ultimate anchor point for said second string, said second string coupled to said second base at said second angle being a string playing notes higher than said first string;

said first string longer than said second string as measured from a common distal anchor line to, respectively, said first and second anchor points to said first and second bases for said first and second strings; and said first string having a first overall headstock length from a proximal end of the fingerboard to said post and said first string having a first fingerboard length from said proximal end of the fingerboard to a distal anchor point of said first string, said first overall headstock length being a harmonic of said first fingerboard length; whereby said first and second strings are more adjustable and harmonic to provide better playing of said first and second strings and said first, second, and third bases obtain structural support from the aligned relationship shared by said first, second, and third bases.

20. A headstock providing angled string attachment points for a stringed instrument having strings strung over a fingerboard as set forth in claim 19, further comprising:

said first string having a first primary headstock length from said proximal end of the fingerboard to a first string tree coupling said first string to said first base, said first primary headstock length being a harmonic of said first fingerboard length.

* * * * *